US005992069A

United States Patent [19]

McKew

[11] Patent Number: 5,992,069

[45] Date of Patent: Nov. 30, 1999

[54] MOTOR VEHICLE IDENTIFICATION DEVICE AND METHOD

[76] Inventor: Olga McKew, 16 Terrace Pl., Mt. Kisco, N.Y. 10549-3012

[21] Appl. No.: 08/916,142

[22] Filed: Aug. 21, 1997

[51] Int. Cl.[6] ..... G09F 17/00

[52] U.S. Cl. ..... 40/591; 40/594

[58] Field of Search ..... 40/607, 591, 594, 40/595, 618

[56] References Cited

U.S. PATENT DOCUMENTS

| | | | |
|---|---|---|---|
| D. 357,204 | 4/1995 | Meissner . | |
| 3,099,947 | 8/1963 | Pottle | 40/618 |
| 3,172,220 | 3/1965 | Christensen | 40/591 |
| 3,526,050 | 9/1970 | Weller . | |
| 3,530,607 | 9/1970 | Willis . | |
| 3,712,263 | 1/1973 | Faragosa . | |
| 4,040,194 | 8/1977 | Penton et al. | 40/607 |
| 4,163,426 | 8/1979 | O'Neill . | |
| 4,526,820 | 7/1985 | Haas . | |
| 4,960,067 | 10/1990 | Currie . | |
| 4,964,360 | 10/1990 | Henry . | |
| 4,972,795 | 11/1990 | Mace . | |
| 4,978,964 | 12/1990 | Castille . | |
| 4,989,536 | 2/1991 | Liming et al. . | |
| 5,078,075 | 1/1992 | Liming et al. . | |
| 5,388,546 | 2/1995 | Lombard . | |

*Primary Examiner*—Cassandra H. Davis

*Attorney, Agent, or Firm*—Whitman Breed Abbott & Morgan LLC; Gregor N. Neff

[57] ABSTRACT

The motor vehicle identification device comprises a kit containing a display device to be attached to the motor vehicle antenna, and a plurality of self-adhesive markers, preferably of different shapes and colors for attachment to the display device in a color combination and pattern of the user's choice. The user thus provides an individualized vehicle identification marker to distinguish that vehicle from others using similar identification devices.

11 Claims, 1 Drawing Sheet

FIG. 1
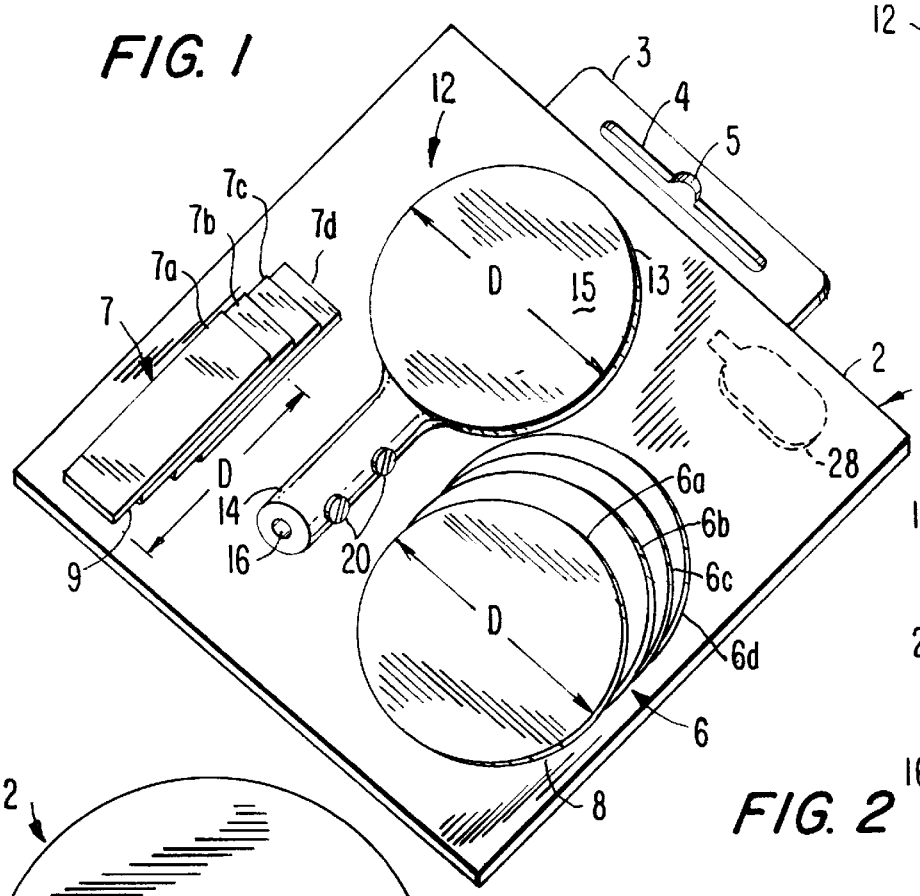
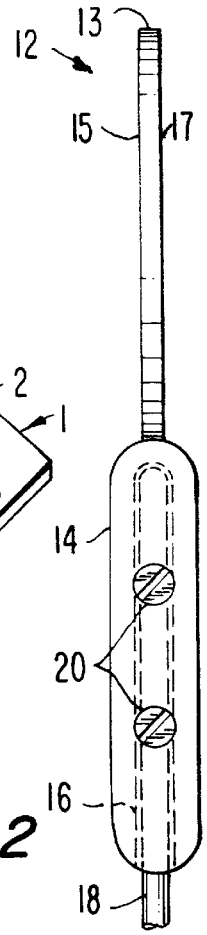
FIG. 2
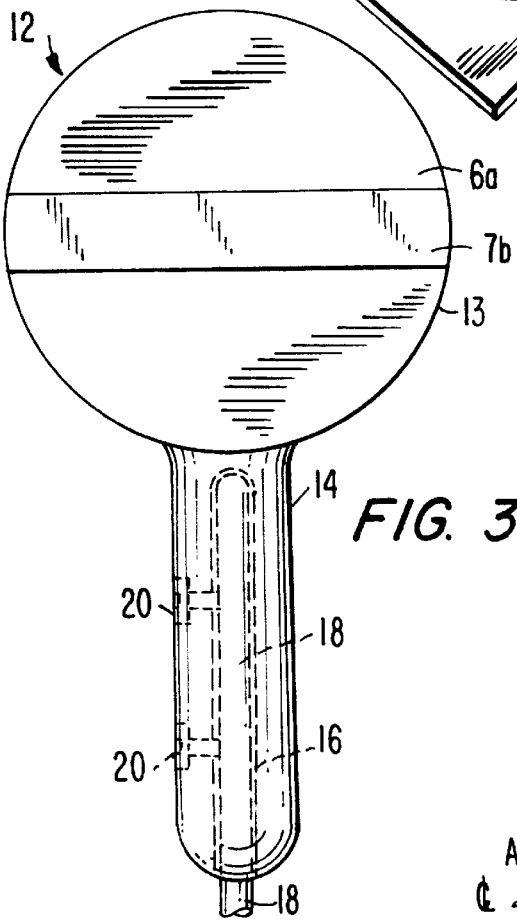
FIG. 3
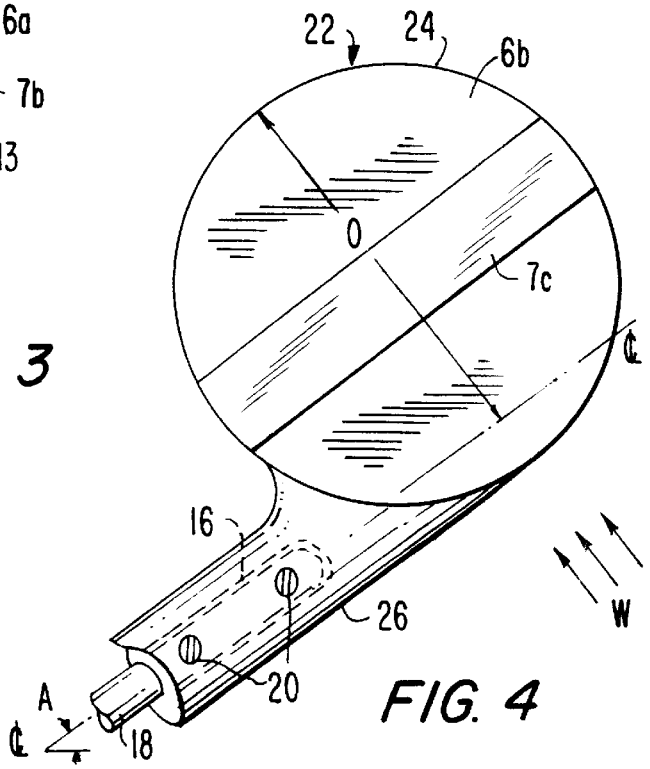
FIG. 4

MOTOR VEHICLE IDENTIFICATION DEVICE AND METHOD

The present invention relates to motor vehicle identification devices, and particularly to such devices which are attached to the antenna of the vehicle.

The problem of locating one's car or truck in a large parking lot filled with such vehicles is well known to many motorists. It often is difficult to remember the specific area of a large lot in which the vehicle was parked, with the result that often one must walk a great deal out of one's way and take a great deal of time in locating one's vehicle.

Some have helped alleviate this problem by tying a piece of colored ribbon or other material to the antenna so that it can be distinguished from a substantial distance away from other automobile antennas and help locate the vehicle.

In addition, numerous devices have been proposed for attachment to the antenna, hopefully to look somewhat neater than a piece of ribbon, while serving the same purpose.

A problem with such prior devices which has been recognized by the inventor of the present invention is that if one of such prior devices becomes particularly popular in a given area, the resulting similarity of the antennas of many different vehicles parked in a large parking lot may seriously limit or destroy the effectiveness of the device in identifying a particular vehicle to its owner.

Although it has been possible for the user of such a prior device to apply his or her own decoration to it, such decoration, at best, is a time-consuming chore for many people. The result is that most antennas look very similar to many others and the identification devices are of limited use.

In addition, if the materials selecting for decoration are not sufficiently waterproof or are of a type which interferes with the antenna's function, the decoration will be short-lived or otherwise undesirable.

Accordingly, it is an object of the present invention to provide a motor vehicle identification device and method which overcomes or alleviates the foregoing problems.

It also is an object of the invention to provide such a device and method which is relatively inexpensive to manufacture, entertaining or interesting to use, long-lasting and simple to use.

The foregoing objectives are satisfied, in accordance with the present invention, by the provision of a kit containing a marker support which can be mounted on the antenna of a motor vehicle, and a plurality of identification markers, each of which is adapted to be attached to the identification support. The contents of the kit are held together by a holder, such as a "blister pack" or similar package.

Preferably, the markers comprise supplies of strip-form pressure-sensitive adhesive materials, such as adhesive tape which can be applied to a surface of the identification support.

It is further preferred that the tape be in the form of individual strips, each having a peel-off backing. The strips preferably are of a size to fit within the confines of the support structure, so that the user will not be required to do much or any trimming.

Sheets of different colors and shapes also preferably are included in the kit so that the user can apply them in different configurations and color combinations to individualize the identification device for his or her vehicle.

It also is preferable that the markers have a light-reflective or luminous surface so as to increase the nighttime visibility of the identification device.

Also in accordance with the present invention, a decoration kit is provided containing a plurality of markers of the type mentioned above, either for re-decorating the identification device of the invention, or for decorating a different identification device of a type not included in the first-named kit.

In the method of identification, the user decorates the identification support member with his or her own artistic design and/or color combination, attaches the support to the antenna, and thereafter has a relatively easy job of identifying his or her car or truck at a distance.

The foregoing and other objects and advantages of the invention will be apparent from or set forth in the following description and drawings.

IN THE DRAWINGS:

FIG. 1 is a perspective view of a motor vehicle identification kit constructed in accordance with the present invention;

FIG. 2 is a side elevation view of the identification marker support of the present invention, attached to a motor vehicle antenna;

FIG. 3 is a front elevation view of the device shown in FIG. 2; and

FIG. 4 is a front elevation view of an alternative embodiment of the device shown in FIGS. 2 and 3.

FIG. 1 shows an automobile identification kit 1 constructed in accordance with the present invention.

The kit 1 comprises a holder having a cardboard backing member 2 with an extending tab 3 with a horizontal slot 4 and a notch 5 for hanging the holder on a display rack spindle. Held in place on the backing card by shrink-wrapped transparent plastic material, for example, is a marker support device 12, and a stack 6 of round identification markers and a stack 7 of elongated rectangular marker identification markers.

FIGS. 2 and 3 show the marker support device 12 in some detail.

The device 12 preferably is a single molded plastic paddle-shaped structure with a relatively broad, flat and relatively thin disk-shaped upper portion 13, and a relatively narrow, thicker stem portion 14. Stem portion 14 has an elongated central hole 16 dimensioned to receive a typical automobile antenna 18. Two set-screws 20 are threaded into two transverse threaded holes at spaced intervals along the length of the stem 14. The set-screws 20 can be loosened with an ordinary screw driver to remove the device 12 from the antenna, and tightened to fasten the device to the antenna.

The disk-shaped upper portion 13 of the device 12 has opposing faces 15 and 17 (FIG. 2) which are relatively smooth for receiving decorative materials.

Referring again to FIG. 1, each of the markers in the stack 6 is shaped so as to cover all or a portion of one of the surfaces of the upper portion 13 of the device 12. In the particular embodiment shown in FIGS. 1 through 3, the disk portion 13 is circular, and the circle has a diameter "D". Similarly, each of the markers in the stack 6 is circular and has a diameter approximately equal to the diameter "D" of the disk 13.

Preferably there is a substantial number of markers in the stack 6. Four such markers 6*a,* 6*b,* 6*c* and 6*d* are shown. More markers can be provided, if desired.

The markers in the stack 7 are rectangular strips, and have a length "D" so as to fit within the confines of the disk 13 of the identification support member 12. A plurality of such strips 7*a,* 7*b,* 7*c* and 7*d* is provided.

Preferably the markers in each of the stacks have different colors. For example, markers being colored red, green, blue and yellow might be provided. It would be desirable to provide at least two of each colored marker so that a marker of the same color can be applied to both sides of the disk 13.

It should be understood that each of the markers 6 or 7 can have a shape other than the specific shapes shown in the drawings. For example, star shaped markers, triangular markers, and other simple yet distinctive shapes can be given to the markers so as to enable the user to design his or her own distinctive automobile identification device.

If desired, a small, rudimentary screw driver 28 as shown in dashed lines in FIG. 1 can be provided as a part of the kit. The screw driver can be a simple flat metal member shaped like a key with a screw driver tip to loosen or tighten the set screws 20 when removing or attaching the device 12 to a vehicle antenna.

Preferably, each of the markers in the stacks 6 and 7 is a piece of waterproof plastic tape colored on one side and having a pressure-sensitive coating on the other side to make it self-adhesive when pressed onto the surface 15 or 17 of the disk 13.

It also is preferable that a covering of a strip 8 or 9 of release liner material which adheres poorly to the adhesive be used to cover the adhesive on each strip so as to prevent it from adhering to surfaces to which its attachment is not desired.

Thus, in using each of the markers, the user peels off the release liner 8 or 9 to expose the adhesive, and attaches the marker to the disk 13.

Markers of different shapes and colors can be applied one on top of the other. For example, in FIG. 3, the disk 13 is shown with one of its surfaces (surface 17) covered with a circular colored disk 6*a,* with a strip of a different color 7*b* applied horizontally across it. Distinctive designs of the owner's own choosing thus can be applied to the disk 13, so as to personalize the identification device.

It also is preferred that the surface of each marker which is to be visible has a light-reflective or luminous surface so as to make it more visible at night.

Suitable reflective adhesive tape is readily available for use on clothing, etc.

Tape or attachments which glow in the dark and thus are luminous also are readily available, as are adhesive tapes with peel-off release liner.

FIG. 4 shows an alternative embodiment 22 of the identification device. This embodiment is the same as that shown in FIGS. 2 and 3, except that the disk portion 24 is not symmetrical with respect to the center line of the hole 16, as in the FIG. 2 embodiment, but is offset from that center line by a substantial distance o.

This serves two different purposes. First, with respect to antennas of automobiles which extend from the automobile at an acute angle "A" (FIG. 4) instead of vertically, the disk 24 can be placed with the alignment shown in FIG. 4 so that the disk 24 extends upwardly substantially above the tip of the antenna 18 so as to make it more easily visible at a distance.

The offset disk 24 also serves another purpose. When attached to a vertical antenna or one at an angle such as that shown in FIG. 4, with the device oriented as shown in FIG. 4, its resistance to the air flow past the moving vehicle in the direction "W" will be minimized, and its tendency to flutter in that airflow also will be reduced.

FIG. 1 also can be considered to show an automobile identification marker kit which does not have a marker device 12 in it. This kit can be used to mark other types of antenna support structures, or to re-mark antenna support structures already owned by the owner of the vehicle.

Other means of attaching the identification device of this invention can be used. For example, a stem without set screws but with a hole of a smaller diameter than the antenna can be used so that the device can be force-fitted onto the antenna.

Many other attachment means are available.

The shape of the identification support 12 also can be changed, as desired.

From the foregoing, it can be seen that the invention described above meets the objectives set forth above. The identification marker device and method provides a means for easily individualizing the marking of an automobile antenna so that the automobile can readily be distinguished from other automobiles having similar devices.

Moreover, the device can be decorated and redecorated to suit the whims and artistic talents of the individual owners, thus giving them enjoyment without the trouble of hunting for and paying excessive amounts for decoration materials.

The identification kit of the present invention does all of this at a relatively low cost to the consumer, and allows the consumer to individualize the identification device quickly and easily, without expensive tools.

It should be readily apparent that the present invention can be practiced in many forms different from the specific forms disclosed herein. Such different forms can be adopted without departing from the spirit or scope of the present invention.

I claim:

1. A motor vehicle identification kit, said kit comprising, in combination;

a holder;

an identification support held by said holder, said support being mountable on the antenna of said vehicle; and a plurality of identification markers held by said holder, each of said markers comprising a sheet having two opposed sides, one of said sides having a coating of pressure-sensitive adhesive, and being adapted to be attached to said support, said support having a first portion adapted to receive said markers and a receptacle portion for receiving said antenna.

2. A kit as in claim 1 in which each of said markers is adapted to be attached to said support in a plurality of different locations, whereby the user of said kit can arrange said markers in a pattern of his or her choice so as to provide individualized identification of said vehicle.

3. A kit as in claim 1 in which at least some of said markers have a color different from that of the others of said markers.

4. A kit as in claim 1 in which at least some of said markers are shaped differently from the others of said markers.

5. A kit as in claim 1 in which each of said coatings of pressure-sensitive adhesive is covered by a second sheet of a material having relatively low adhesion to said adhesive, whereby said second sheet can be peeled off of said coating relatively easily to expose said adhesive coating and thus prepare said marker to be applied to said support.

6. A kit as in claim 1 in which each of said markers has a surface selected from the group consisting of a light reflecting surface and a luminous surface.

7. A motor vehicle identification kit, said kit comprising, in combination;

a holder;

an identification support held by said holder, said support being mountable on the antenna of said vehicle; and a plurality of identification markers held by said holder, each of said markers being adapted to be attached to said support, said support having a first portion adapted to receive said markers, and a receptacle portion for receiving said antenna and comprises a single molded body member with an elongated hole forming said receptacle, said first portion being asymmetric and extending a substantial distance in one direction away from the centerline of said hole.

8. A motor vehicle identification kit, said kit comprising, in combination;

a holder;

an identification support held by said holder, said support being mountable on the antenna of said vehicle; and a plurality of identification markers held by said holder, each of said markers being adapted to be attached to said support, said support having a first portion adapted to receive said markers, and a receptacle potion for receiving said antenna, said holder comprising a container which has at least one transparent wall through which the container's contents can be seen.

9. A motor vehicle identification kit, said kit comprising, in combination;

a holder;

an identification support held by said holder, said support being mountable on the antenna of said vehicle; and a plurality of identification markers held by said holder, each of said markers being adapted to be attached to said support, said support having a first portion adapted to receive said markers, and a receptacle portion for receiving said antenna and in which said marker support has fasteners to fasten it to an antenna, and said kit includes a tool for loosening and tightening said fasteners.

10. A method of identifying a motor vehicle which has an antenna extending outwardly from the body of said vehicle, said method comprising the steps of;

(a) providing a kit having a marker support mountable on said antenna and a plurality of different markers attachable to said support, in which said support has at least one smooth surface and said markers comprise strips of self-adhesive tape which can be adhered to said surface, and in which said support has a receptacle portion for receiving an antenna;

(b) attaching at least one of said markers to said support in a desired disposition to produce a desired visual effect; and (c) mounting said support on said antenna.

11. A method as in claim 10 in which said attaching step comprises attaching a plurality of markers to said support in a desired pattern, and in which said markers comprise a plurality of strips of self-adhesive tape of different colors and, optionally, of different shapes, and having a light-reflective or luminous surface so as to have improved visibility in the dark.

* * * * *